United States Patent [19]

Craig

[11] Patent Number: 4,899,987

[45] Date of Patent: Feb. 13, 1990

[54] VEHICLE SCISSOR LIFT

[75] Inventor: Thomas A. Craig, Milwaukee, Wis.

[73] Assignee: Hein-Werner Corporation, Waukesha, Wis.

[21] Appl. No.: 281,489

[22] Filed: Dec. 8, 1988

[51] Int. Cl.[4] ..... B66F 3/22

[52] U.S. Cl. ..... 254/122; 254/124

[58] Field of Search ..... 254/122, 124, 9 R, 9 C, 254/9 B; 182/8.71, 8.72, 18

[56] References Cited

U.S. PATENT DOCUMENTS

| | | | |
|---|---|---|---|
| 3,150,784 | 9/1964 | Rothe | 254/124 |
| 4,221,280 | 9/1980 | Richards | 254/122 |
| 4,447,042 | 5/1984 | Masui | 254/124 |
| 4,753,419 | 6/1988 | Johansson | 254/122 |

*Primary Examiner*—Judy Hartman

*Attorney, Agent, or Firm*—Michael, Best & Friedrich

[57] ABSTRACT

The scissor lift has two parallel sets of legs. Each set has one end of an inner leg pivoted on a base and the other end slideable on the elevating platform. One end of the outer leg of each set is pivotally connected to the platform while the other end slides on the base. The mid portion of the legs are pivotally connected on a pin which also supports a crank which can rotate about 90° between a first generally horizontal position in which the actuated end of the crank is eccentric to an imaginary line connecting the pivot pin and the pivot of a ram which actuates the end of the crank. Initial actuation of the crank 90° raises the pivot pin and the actuated end of the crank to increase the mechanical advantage of the ram. The angle of the ram now has adequate uplift to be as effective as the prior art while requiring about ½ the storage height. A stop bar is pivoted on the pivot pin and has a free end or tail slideable along the base as the pivot pin rises. A plurality of spaced stops are welded on the base along the path of the tail and are engaged by the stop bar as the lift is lowered due to pressure loss or failure to actuate a control cable to lift the lock bar over the stops.

6 Claims, 3 Drawing Sheets

VEHICLE SCISSOR LIFT

FIELD OF THE INVENTION

This invention relates to automotive service lifts of the type mounted on the floor in service garages, and more particularly to service lifts including scissor type linkages for raising a vehicle.

BACKGROUND PRIOR ART

Scissor lifts of the type mounted on the floor of a service area project above the surface even when fully collapsed. Typically, such lift arrangements when fully collapsed have a height of at least six inches above the floor and, in many cases, more than that. When the service lifts are not in use, they present an obstacle to people working in the area and they obstruct movement of vehicles and equipment in the service area. Accordingly, in many cases, scissor lifts are recessed into the floor, and installation of the lifts is expensive because of the work required in forming a recess in the floor for housing the service lift.

SUMMARY OF THE INVENTION

The present invention provides a scissor lift for use in vehicle service facilities which has a substantially reduced height or thickness when the lift is collapsed and minimizes the need for recessing the service lift into the floor.

In the scissor lift embodying the invention, a hydraulic ram is connected to the pivot of the pairs of scissors of the scissor lift by a crank and roller assembly The crank and roller assembly is caused to pivot by initial elongation of the hydraulic ram and functions to elevate the scissors pivot point while at the same time increasing the effective angle of the ram with respect to horizontal to thereby increase the mechanical advantage of the hydraulic ram. This results in providing a means for initiating upward movement of the scissor arrangement and also for rapidly increasing the mechanical advantage of the hydraulic ram during the initial stage of scissor movement. The scissor lift embodying the invention can have a height which is one-half the height of the prior art scissor lifts and yet does not sacrifice mechanical advantage.

Another feature of the scissor lift embodying the invention is that it includes a lock bar pivoted on the pivot pin interconnecting the scissors legs and having a lower end which can engage successive spaced stops on the base. The lock bar and spaced stops function as a ratchet or rack and pawl arrangement as the lift is raised, and if pressure in the hydraulic ram is lost, the end of the lock bar engages a stop to prevent dropping the load. To lower the scissor lift, the lower end of the lock bar can be raised to lift the lower end of the bar over the stops.

DETAILED DESCRIPTION OF THE DRAWINGS

Figure 1:
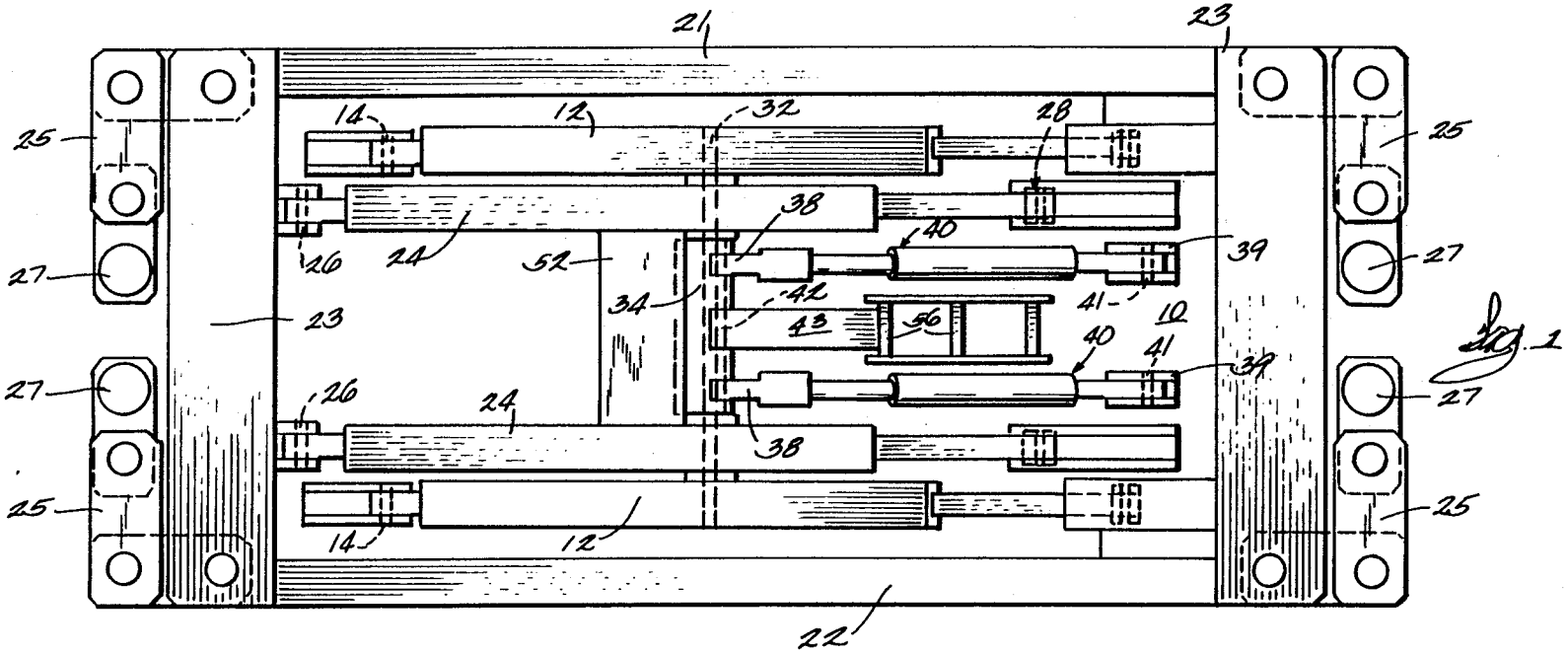
FIG. 1 is a plan view of a scissor lift embodying the invention in a raised position.
Figure 2:
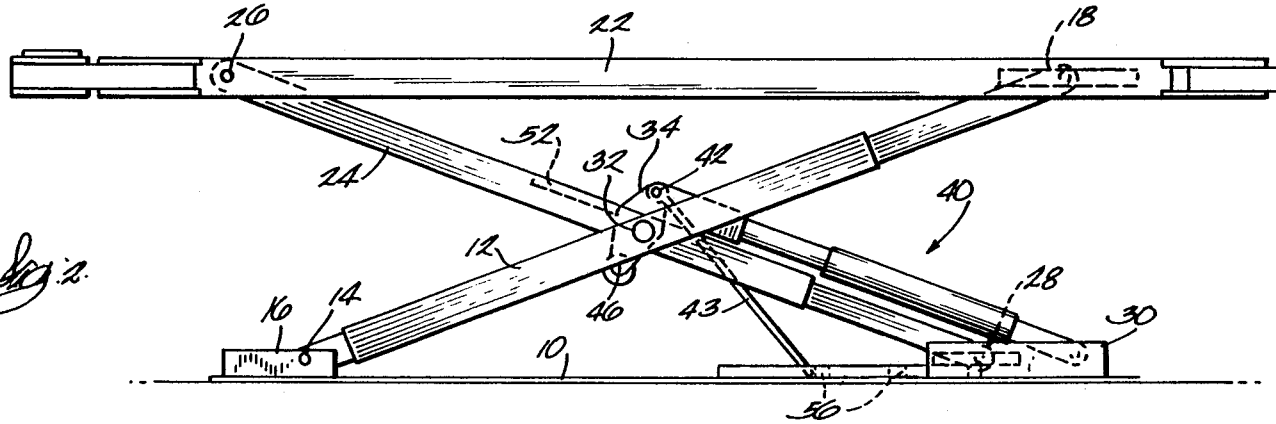
FIG. 2 is a side elevation of the scissor lift shown in FIG. 1.

Illustrated in FIG. 1 is a vehicle scissor lift embodying the invention and including a base 10 supporting a set of inner scissor legs 24 and a pair of outer scissor legs 12. Each outer leg 12 includes one end pivotally supported on the base by a pivot pin 14 in turn supported by a bracket or block 16. The other end of each leg 12 is provided with a pivoted slider block 18 which slides in and is restrained in a guide track 20 fixed to the elevating platform 22. While the elevating platform 22 could have other constructions, in the illustrated arrangement it includes a frame comprised of a pair of side bars 21 joined by end bars 23. The opposite ends of the frame 22 each support a plurality of pivoting arms 25, in turn, each supporting a support pad 27 adapted to be positioned under the frame of a vehicle for lifting the vehicle.

Each inner leg 24 includes one end pivotally joined to the platform 22 by a pivot pin 26, and an opposite end of each inner leg 24 is pivotally connected by a pin 29 (FIG. 6) to a slider block 28 which is housed in a slider block guide bracket 30 fixed to the base 10 and supported by the guide bracket 30 for limited linear reciprocal movement. The medial portions of the legs 12 and 24 are pivotally interconnected by a pivot Pin 32. The pivot pin 32 also supports and serves as a pivot or fulcrum for a pivot bar or crank 34 positioned between the two pairs of legs 12 and 24. The pivot bar 34 constitutes a double ended crank having its mid-portion pivoted on Pin 32. Each end of the pivot bar includes spaced apart ears 36, nd the space between the ears 36 is adapted to house an end of a piston rod 38 of a hydraulic ram 40. A pivot pin 42 extends through all the ears 36 and through the ends of pairs of piston rods 38. The opposite ends of the hydraulic rams 40 are pivotally connected to the base 10 by brackets 39 fixed to the base 10 and pivot pins 41 extending through the brackets 39 and through ends of the hydraulic cylinders 40.

Figure 3:
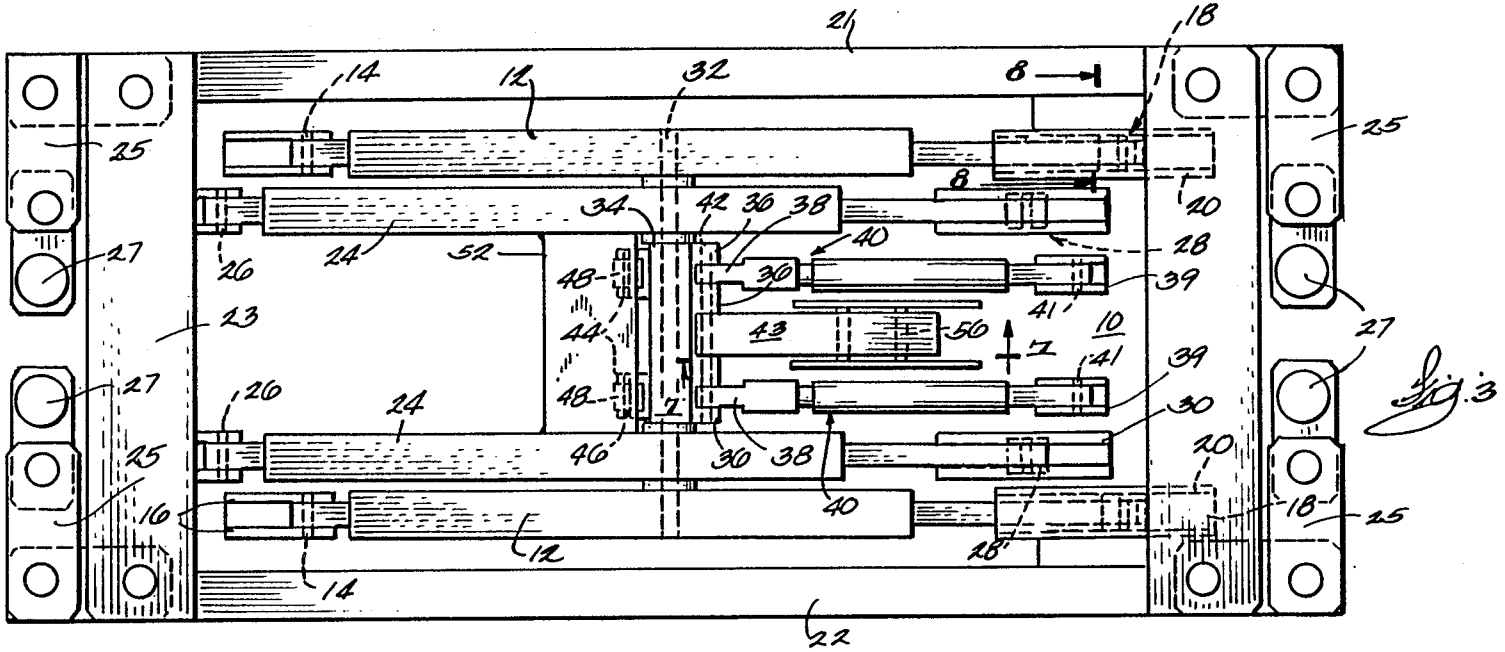
FIG. 3 is a plan view of the lift shown in FIG. 1 in a collapsed position.
Figure 4:
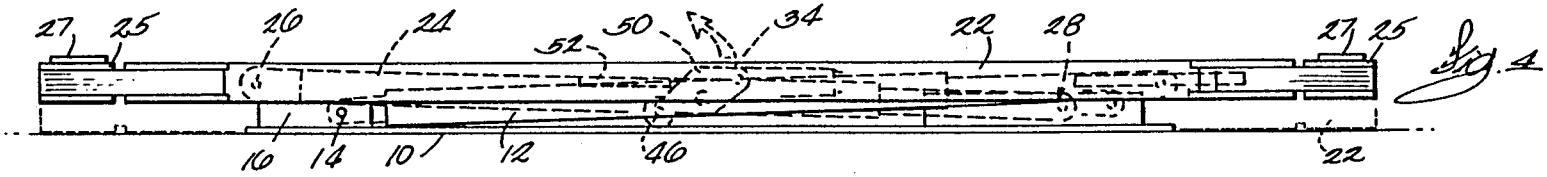
FIG. 4 is a side elevation of the scissor lift shown in FIG. 3, and showing the lift in a fully collapsed position in phantom.
Figure 5:
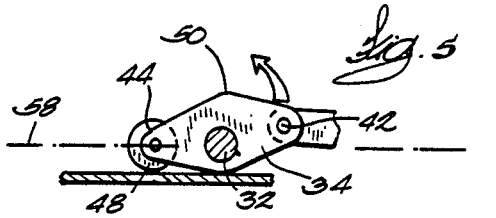
FIG. 5 is a detailed elevation view of the crank assembly which imparts the initial upward movement to the scissor lift shown in FIGS. 1–4.
Figure 6:
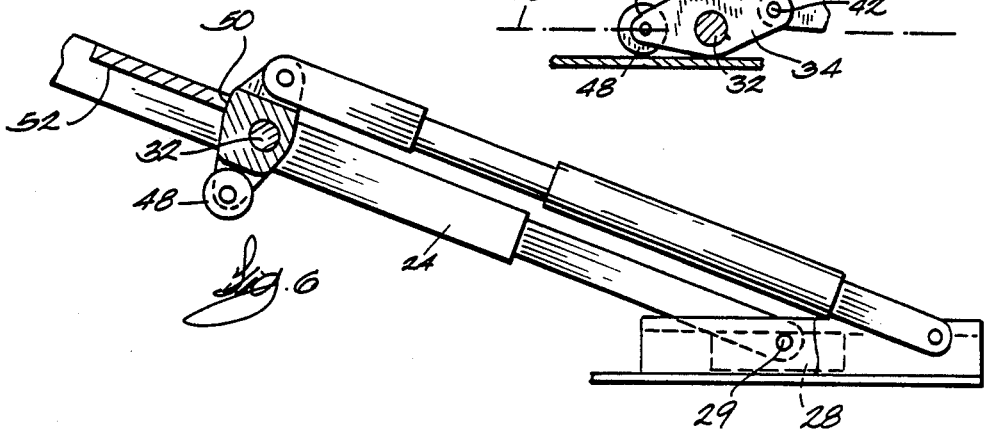
FIG. 6 is an enlarged partial view of the lifting ram and crank assembly of the scissor lift shown in FIGS. 1–4.

The opposite "end" of the pivot bar or crank 34 includes two more pairs of spaced ears 44 (FIG. 3) which support pivot shafts 46 on which rollers 48 are mounted. In the fully collapsed position of the scissor lift, (as shown in phantom in FIG. 4) the rollers 48 engage the upper surface of the floor of the base 10, and the crank 34 is generally horizontally disposed but with pivot pin 42 slightly above the axis of the main pivot pin 32 and above the pivot pin 41 supporting the lower end of the ram 40. Thus, as best shown in FIGS. 5 and 6, when the scissor lift is in the fully lowered position and when the ram is then extended, the ram 40 will apply a torque on the crank 34 about the main pivot pin 32 in a counterclockwise direction, as seen in FIG. 5, and force the crank 34 to pivot on pin 32. This causes the roller 48 to roll on the base 10. As the crank 32 rotates in the counterclockwise direction, the pivot 32 is raised by the crank, and the pivot pin 42 connecting the end of the crank to piston end 38 also moves upwardly to now give the ram 40 an increased vertical angle and increased leverage. The crank 34 pivots about pin 32 approximately 90° to the position shown in FIG. 6 wherein a stop surface 50 of the crank 34 engages the edge of a stop plate 52 which interconnects and is fixed between the inner legs 24. Once the crank 34 has pivoted to the generally vertical position, the point of engagement of the ram 40 with the crank 34 is at a position of maximum advantage and continued extension of the ram 40 will cause the scissor legs 12 and 24 to pivot about the anchor pivots 14 and 26 thereby causing the platform 22 to be elevated.

Figure 7:
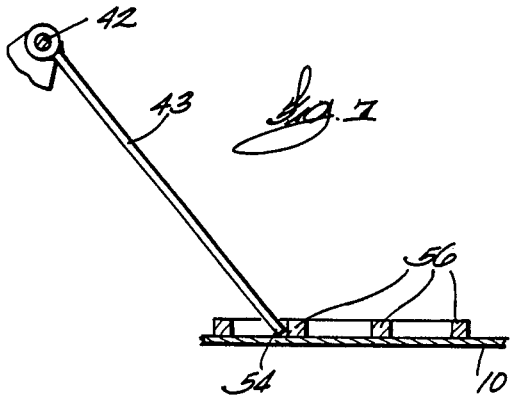
FIG. 7 is an enlarged view of a locking bar assembly included in the scissor lift shown in FIGS. 1–4.
Figure 8:
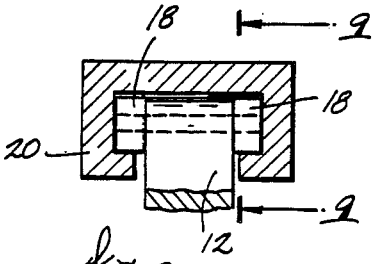
FIG. 8 is a cross section view taken along line 8—8 in FIG. 3.
Figure 9:
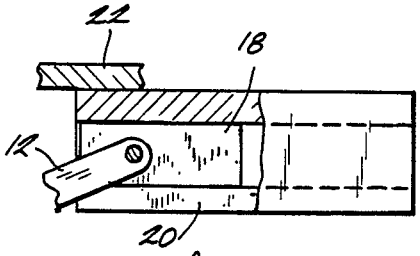
FIG. 9 is a cross-section view taken along line 9—9 in FIG. 8.

In the illustrated arrangement the scissor lift also includes a lock bar 43 having one end pivotally joined to the crank 34 by pivot pin 42. As the platform 22 rises, a lower end 54 (FIG. 7) of the lock bar 43 will drag along the base and will ride over spaced stops 56 fixed to the base 10. In order to lower the scissor lift, the lower end 54 of stop bar 42 has to be raised over the stops 56.

When the scissor lift embodying the invention is in the lowered or retracted position, it has a very low profile. Because the scissor lift has a low profile, it can be installed in a garage or service area on the existing floor, and modification of the floor to recess the scissor lift into the floor is not required. Additionally, because the scissor lift can be readily installed, it can be moved from one service area to another at minimal expense. The low profile of the scissor lift is permitted by the provision of the crank arrangement 34 and provides means for initiating upward movement of the scissor lift when the hydraulic ram is in a nearly horizontal position, and the moment arm of the force generated by the hydraulic ram would be otherwise insufficient to cause lifting movement of the lift arms of the scissor lift.

Various features of the invention are set forth in the following claims.

I claim:

1. A hydraulically operated scissor lift comprising:

a base;

a platform supported for vertical movement with respect to the base;

a first leg having opposite ends, one end pivotally connected to the base and the other end slideably connected to the platform, a second leg having opposite ends, one end of the second leg being pivotally connected to the platform and the opposite end of the second leg being slideably connected to the base, a pivot interconnecting the mid portion of the first leg to the mid portion of the second leg;

a crank which rotates independently of said first and second legs, said crank being mounted on the pivot, the crank having opposite ends, and including a roller on open end of the crank, and the crank being pivotable on the pivot between a first position in which the crank is generally horizontal and a second position in which the crank is generally vertical; and a hydraulic ram having opposite ends, one end of the hydraulic ram being connected to the base and the other end of the hydraulic ram being connected to the other end of the crank, the hydraulic ram being extendable and adapted to cause pivotal movement of the crank between the first position and the second position during initial extension of the hydraulic ram;

whereby initial movement of the hydraulic ram pivots the crank about the pivot to force the roller against the base, thereby elevating the pivot vertically to provide initial lift, and whereby further movement of the hydraulic ram lifts the crank out of engagement with the base as the hydraulic ram continues to raise the platform.

2. A scissor lift as set forth in claim 1 including a third leg parallel to said first leg, said third leg having opposite ends, one end of the third leg pivotally connected to the base and the other end of the third leg slideably connected to the platform, and a fourth leg parallel to the second leg and having opposite ends, one end of the fourth leg being pivotally connected to the platform and the opposite end of the fourth leg being slideably connected to the base, and the third leg and the fourth leg being pivotally joined together by the pivot.

3. A scissor lift as set forth in claim 2 and further including means for locking the platform in a raised position.

4. A hydraulically operated scissor lift adapted to be supported on a support surface, the hydraulically operated scissor lift comprising:

a platform supported for vertical movement with respect to the support surface;

a first leg having opposite ends, one end adapted to be pivotally connected to the support surface and the other end slideably connected to the platform, a second leg having opposite ends, one end of the second leg being pivotally connected to the platform and the opposite end of the second leg being slideably supported by the support surface, a pivot interconnecting the mid portion of the first leg to the mid portion of the second leg;

a crank which rotates independently of said legs, said crank being pivotally joined to at least one of the first leg and second leg adjacent the pivot, the crank having opposite ends, and the crank being pivotable between a first position in which the crank is generally horizontal and a second position in which the crank is generally vertical; and a hydraulic ram having opposite ends, one end of the hydraulic ram being adapted to be supported by the support surface and the other end of the hydraulic ram being connected to one end of the crank, the hydraulic ram being extendable and adapted to cause pivotal movement of the crank between the first position and the second position during initial extension of the hydraulic ram;

whereby initial movement of the hydraulic ram pivots the crank about the pivot to force the other end of the crank against the support surface, thereby elevating the pivot vertically to provide initial lift, and whereby further movement of the hydraulic ram lifts the crank out of engagement with the support surface as the hydraulic ram continues to raise the platform.

5. A scissor lift as set forth in claim 4 including a third leg parallel to said first leg, said third leg having opposite ends, one end of the third leg adapted to be pivotally supported by the support surface and the other end of the third leg slideably connected to the platform, and a fourth leg parallel to the second leg and having opposite ends, one end of the fourth leg being pivotally connected to the platform and the opposite end of the fourth leg being adapted to be slideably supported by the support surface, and the third leg and the fourth leg being pivotally joined together by the pivot.

6. A scissor lift as set forth in claim 5 and further including means for locking the platform in a raised position.

* * * * *

UNITED STATES PATENT AND TRADEMARK OFFICE

CERTIFICATE OF CORRECTION

PATENT NO. : 4,899,987

DATED : February 13, 1990

INVENTOR(S) : Thomas A. Craig

It is certified that error appears in the above-identified patent and that said Letters Patent is hereby corrected as shown below:

Column 3, line 58, "open" should read --one--.

Signed and Sealed this

Sixteenth Day of July, 1991

*Attest:*

HARRY F. MANBECK, JR.

*Attesting Officer*

*Commissioner of Patents and Trademarks*